US006540572B2

(12) United States Patent
Buzzi

(10) Patent No.: US 6,540,572 B2
(45) Date of Patent: Apr. 1, 2003

(54) PROPULSION SYSTEM FOR MOTOR BOATS

(75) Inventor: Fabio Buzzi, Oggiono (IT)

(73) Assignee: F.B. Design S.r.l., Annone Brianza (IT)

( * ) Notice: Subject to any disclaimer, the term of this patent is extended or adjusted under 35 U.S.C. 154(b) by 0 days.

(21) Appl. No.: 09/767,941

(22) Filed: Jan. 24, 2001

(65) Prior Publication Data

US 2002/0127928 A1 Sep. 12, 2002

(30) Foreign Application Priority Data

Aug. 23, 2000 (IT) ..... MI00A1899

(51) Int. Cl.[7] ..... B63H 23/00; B63H 21/30

(52) U.S. Cl. ..... 440/75; 440/61; 440/111; 440/112

(58) Field of Search ..... 440/75, 111, 112, 440/61, 56, 71

(56) References Cited

U.S. PATENT DOCUMENTS

| | | | | |
|---|---|---|---|---|
| 2,022,652 A | * | 12/1935 | Fahrney et al. | 440/112 |
| 2,856,883 A | * | 10/1958 | Baker | |
| 3,175,530 A | * | 3/1965 | Petterson | 440/57 |
| 3,469,558 A | * | 9/1969 | Puretic | 440/53 |
| 5,944,569 A | | 8/1999 | Buzzi | |

FOREIGN PATENT DOCUMENTS

| | | | | |
|---|---|---|---|---|
| EP | 0 296 797 A1 | * | 12/1988 | 440/111 |
| EP | 450507 | | 7/1994 | |
| EP | 811551 | | 10/1997 | |

* cited by examiner

*Primary Examiner*—Sherman Basinger
(74) *Attorney, Agent, or Firm*—Millen, White, Zelano & Branigan, P.C.

(57) ABSTRACT

A propulsion system for motor boats is described, wherein the motor unit and the support member for the propeller shaft are mechanically connected together.

11 Claims, 5 Drawing Sheets

PROPULSION SYSTEM FOR MOTOR BOATS

FIELD OF THE INVENTION

The present invention concerns a propulsion system for motor boats and, in particular, a so-called "V-drive" type propulsion system.

BACKGROUND OF THE INVENTION

In propulsion systems of this type, anyway known for many years, the driving shaft exits from the motor unit towards the bow of the hull and is connected, directly or indirectly, to a reversing gearbox or inverter. From the latter thus exits the propeller shaft of the propeller, obviously turned towards the stern of the hull.

Instead, in the more conventional propulsion systems, the kinematic chain is basically aligned in sequence from the motor unit until the propeller. An example of these more conventional propulsion systems is described in the Italian patent application no. MI96A-001151 and in the corresponding patent publications no. U.S. Pat. No. 5.944.569 and no. EP-A-811551.

Compared to the conventional propulsion systems, the V-drive type systems have various advantages, among which is the setting back of the motor unit weight and the possibility of reducing the propeller axis inclination.

In the case of direct connection between the driving shaft and reversing gearbox, in which the latter is integrally connected with the motor unit, these system types also allow a considerable saving of internal space.

Nevertheless, propulsion systems of this type give particular problems during the assembly stage, especially in obtaining the correct alignment between the motor unit and the rest of the propulsion system, i.e. the reversing gearbox and propeller shaft.

In fact, the propeller shaft exiting from the reversing gearbox remains under the motor unit and the correct alignment between the propeller and driving shaft axes cannot be checked visually. For this reason, it is often necessary to connect the driving shaft indirectly to the reversing gearbox, for instance interposing cardan shafts that tolerate even slight alignment errors. However, this solution compromises some of the advantages offered by the V-drive type systems.

SUMMARY OF THE INVENTION

The task of the present invention is to provide a V-drive type propulsion system that obviates the drawbacks of the known technique.

Within the scope of this task, one object of the present invention is to provide a propulsion system for motor boats that finally solves the alignment problems between the motor unit and the remaining part of the propulsion system.

Another object of the present invention is to provide a propulsion system for motor boats that simplifies the assembly operations of same propulsion system on the hull.

A further object of the present invention is to provide a propulsion system for motor boats that also allows the particularly simple and quick variation in the axis inclination of the propeller with respect to the hull bottom.

These objects are achieved by the present invention, which concerns a propulsion system for motor boats, of the type comprising at least one motor unit, at least one reversing gearbox connected to the shaft existing from the motor unit, at least one propeller shaft to transmit the movement from the reversing gearbox to the propeller of the system, and at least one support member for the propeller shaft to be fixed to the hull bottom near the propeller, characterized in that it comprises means to mechanically connect together the at least one motor unit and the support member for the propeller shaft.

In this way a single block is produced which combines the motor unit, the reversing gearbox and the support member of the propeller shaft in one integral structure, thus allowing the correct alignment between motor unit and propeller shaft already during the construction stage of the propulsion system, According to the preferred embodiment of the present invention, the propulsion system is of "V-drive" type and, even more preferably, the reversing gearbox is integral with the motor unit. Hence a particularly compact "closed ring" structure is produced. which considerably simplifies the installation of the propulsion system on any motor boat. This also allows an advantageous reduction in the length of the propeller shaft.

In a possible embodiment of the present invention, the means of mechanical connection include at least one portion of the support member that protrudes inside the hull.

The means of mechanical connection can also include one or more devices for the support of the motor unit.

According to a possible embodiment, the propulsion system includes one or more devices that allow adjustment of the propeller shaft inclination with respect to the bottom of the motor boat on which it is assembled. In fact, being able to work on a single integral structure makes it very simple to vary the inclination of the propeller shaft, and hence the propeller axis, with respect to the hull.

According to a further possible embodiment, the means for mechanically connecting together the motor unit and the support member for the propeller shaft include one or more hydraulic actuators. This allows the closed ring structure of the propulsion system to pivot around an axis and, consequently, to adjust the inclination of the propeller shaft also during running. In this case the transmission is made "frimmable", according to the nautical terminology used for speedboats, i.e. the trim assumed by the propeller axis with respect to the water surface, may be adjusted.

DETAILED DESCRIPTION

Additional features and advantages of the present invention will become apparent from the following description, with reference to to the attached drawings, in which.

DESCRIPTION OF THE PREFERRED EMBODIMENTS

Figure 1:
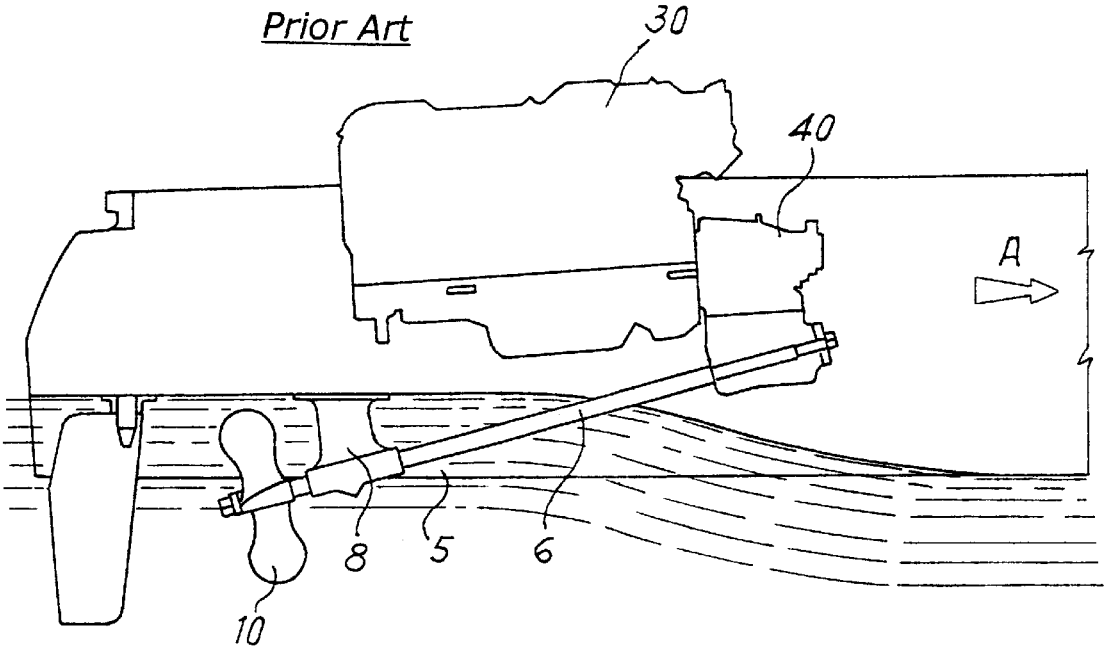
Fig. 1 Prior Art
FIG. 1 is a longitudinal section view of the stern portion of a motor boat equipped with a known immersed propeller propulsion system of the "V-drive" type.
Figure 2:
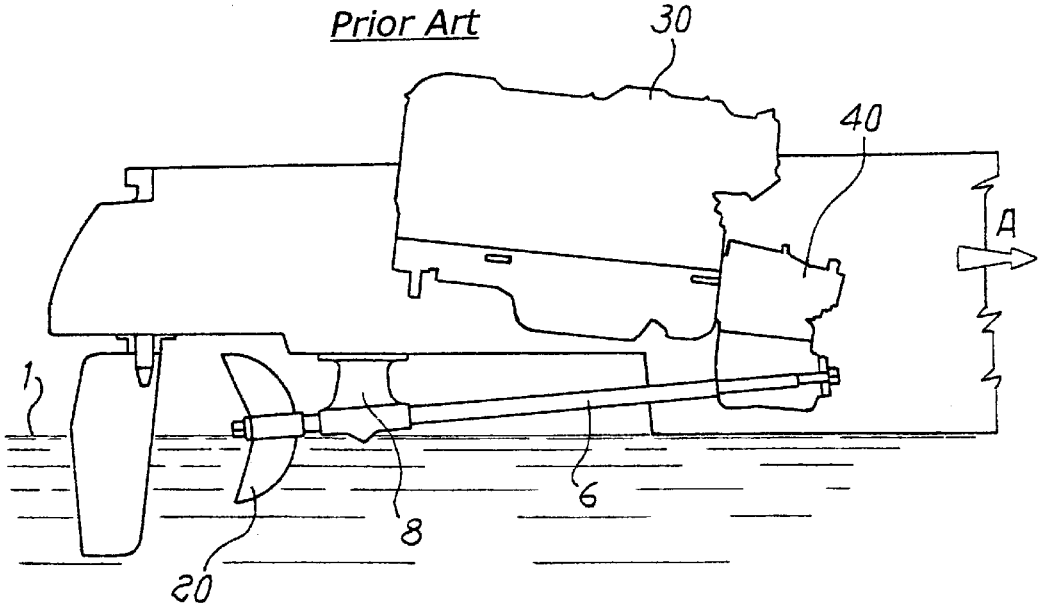
Fig. 2 Prior Art
FIG. 2 is a longitudinal section view of the stern portion of another motor boat equipped with a known surface propeller propulsion system of the "V-drive" type.

FIGS. 1 and 2 show propulsion systems of known "V-drive" type installed on motor boats that make use of two different propulsion principles.

The bottom of the hull of FIG. 1 is made for an immersed propeller propulsion system, in which the propeller 10 is housed in a tunnel 5 radiused to the bottom profile to decrease the draft of the same propeller and limit the hydrodynamic resistance caused by the final transmission section, i.e. by the propeller shaft 3 and the support member 8.

The bottom of FIG. 2 is made instead for a surface propeller propulsion system, in which the propeller 20 is only partially immersed, while the propeller shaft 6 and the support member 8 for the same are located above the water surface 1. First of all, this solution allows a reduction in the resistance due to friction of the appendices, in addition to limiting the inclination of the axis of the propeller 20 with respect to the water surface with consequent advantages from the point of view of efficiency.

Whichever propulsion principle is adopted, the known "V-drive" type systems shown in FIGS. 1 and 2 basically include a motor unit 30 and a reversing gearbox 40, integrally assembled with the motor unit 30, that allows the reversal of boat running with respect to the advancement direction indicated by arrows A. The propeller shaft 6 exits from the reversing gearbox 40 that is supported, near the propeller 10 or 20, by a support member 8 fixed to the bottom of the hull.

Only a V-drive type propulsion system according to the present invention will be illustrated hereinafter for simplicity, with reference mainly to an embodiment with surface propeller, like that shown in FIG. 2, but it is evident that the same propulsion system could also be applied to the boats designed for propulsion with immersed propeller.

Figure 3:
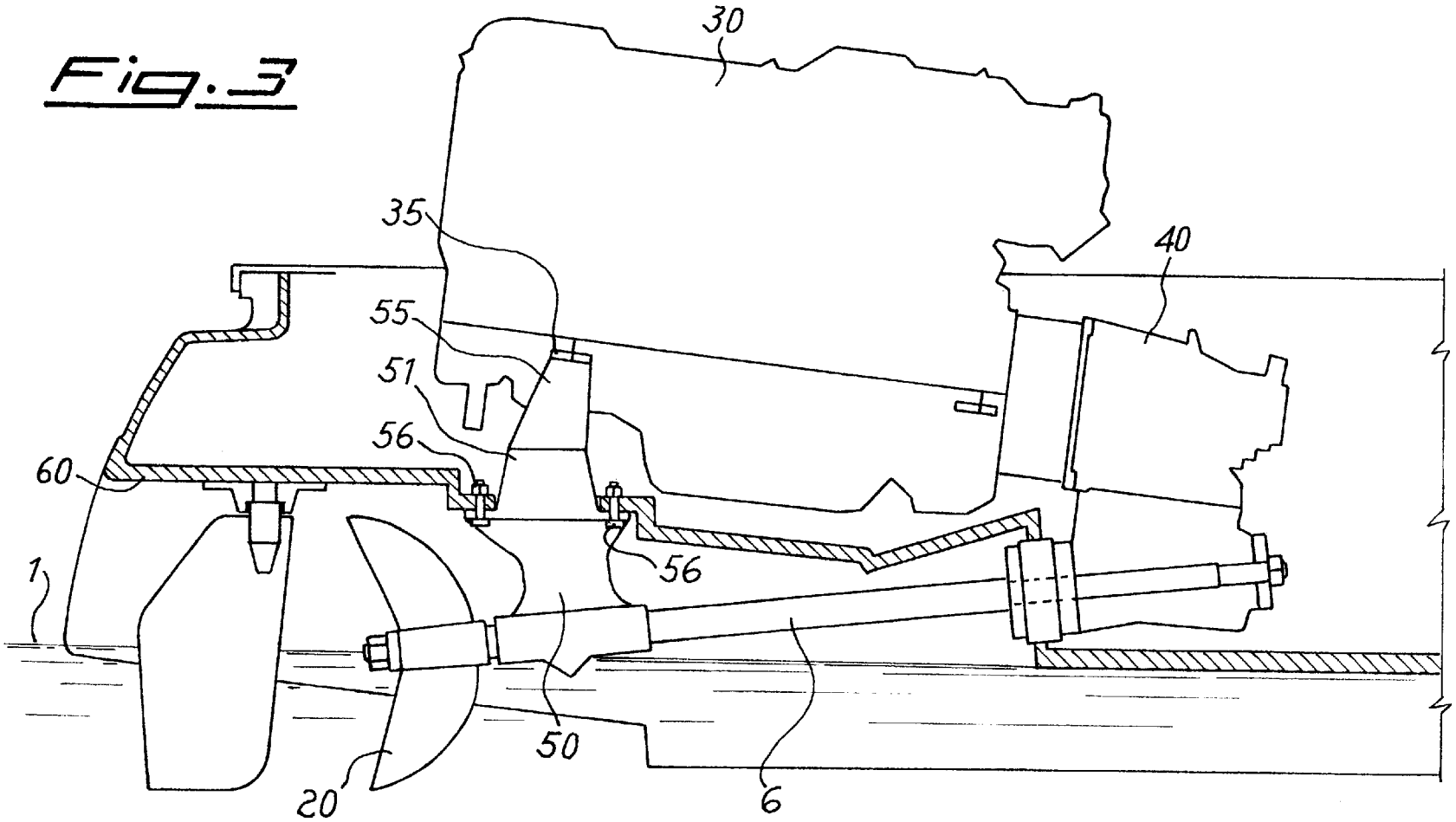
FIG. 3 is a longitudinal section view of the stern portion of a motor boat equipped with a propulsion system according to a possible embodiment of the present invention.

A possible embodiment of the V-drive type propulsion system, according to the present invention, is illustrated in the enlarged view of FIG. 3, where the mechanical connection is clearly visible between the motor unit 30 and support member 50 made by means of a portion 51 that penetrates inside the hull 60. A shaped bracket 55 is connected to portion 51, or made integral with the same, onto which the motor unit 30 is fixed at its front attachments 35 (rear with respect to the orientation of the hull) by means of known type fixing devices. The support member 50 is fixed to the hull 60 at its plate portion by means of known fixing devices 56, e.g. screws or bolts joined with respective nuts.

Thus a closed mechanical "ring" or "mechanical loop" is formed, including the motor unit 30, the reversing gearbox 40, the propeller shaft 6 and the support member 50, that avoids any alignment errors. Indeed, the correct alignment is ensured during the design stage and is, above all, independent of the hull.

Figure 4:
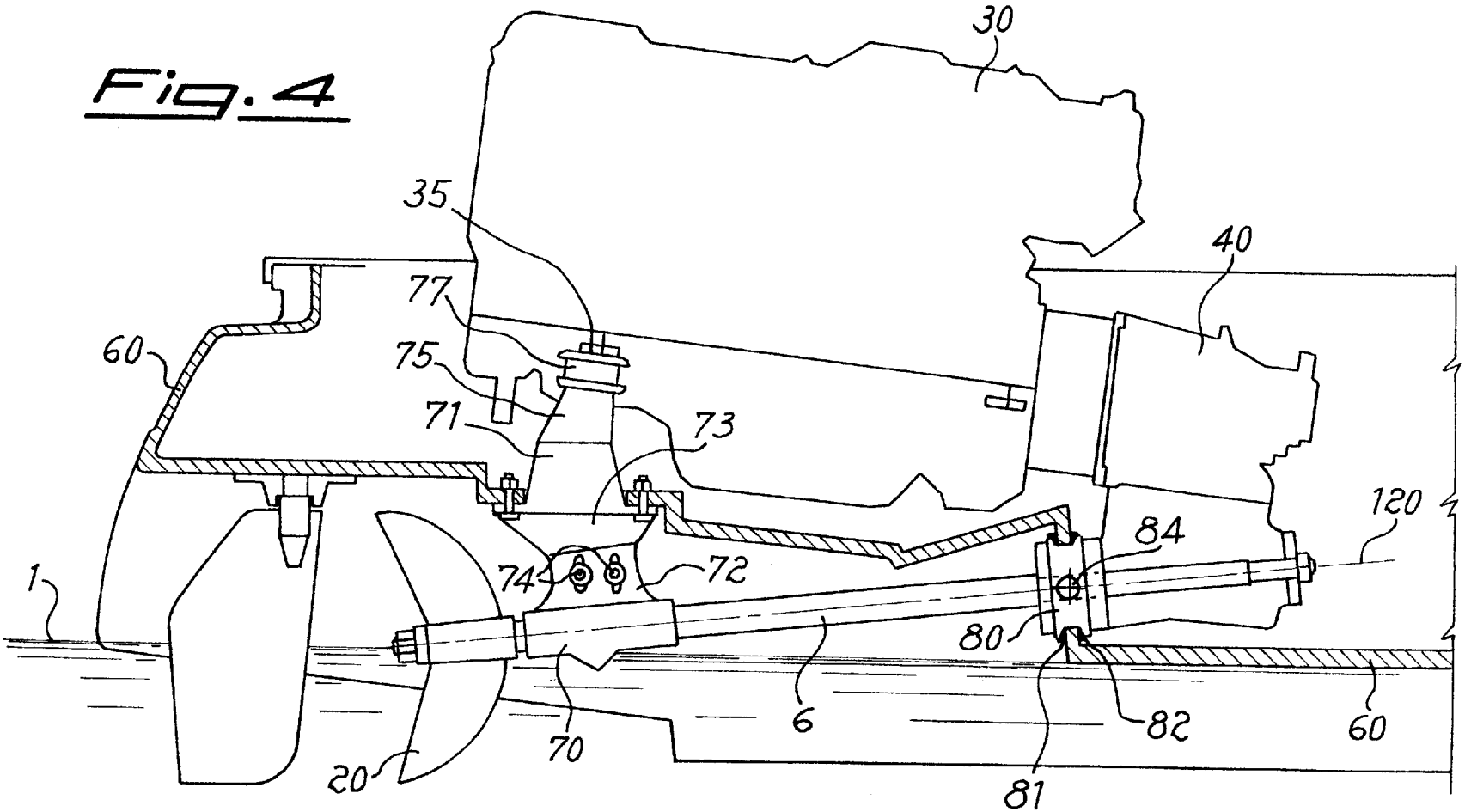
FIG. 4 is a longitudinal section view of the stern portion of a motor boat equipped with a propulsion system according to another possible embodiment of the present invention.

FIG. 4 shows another possible embodiment of the "V-drive" type propulsion system according to the present invention, which advantageously envisages some devices that allows variation of the axis inclination of the propeller with respect to the hull.

Figure 5:
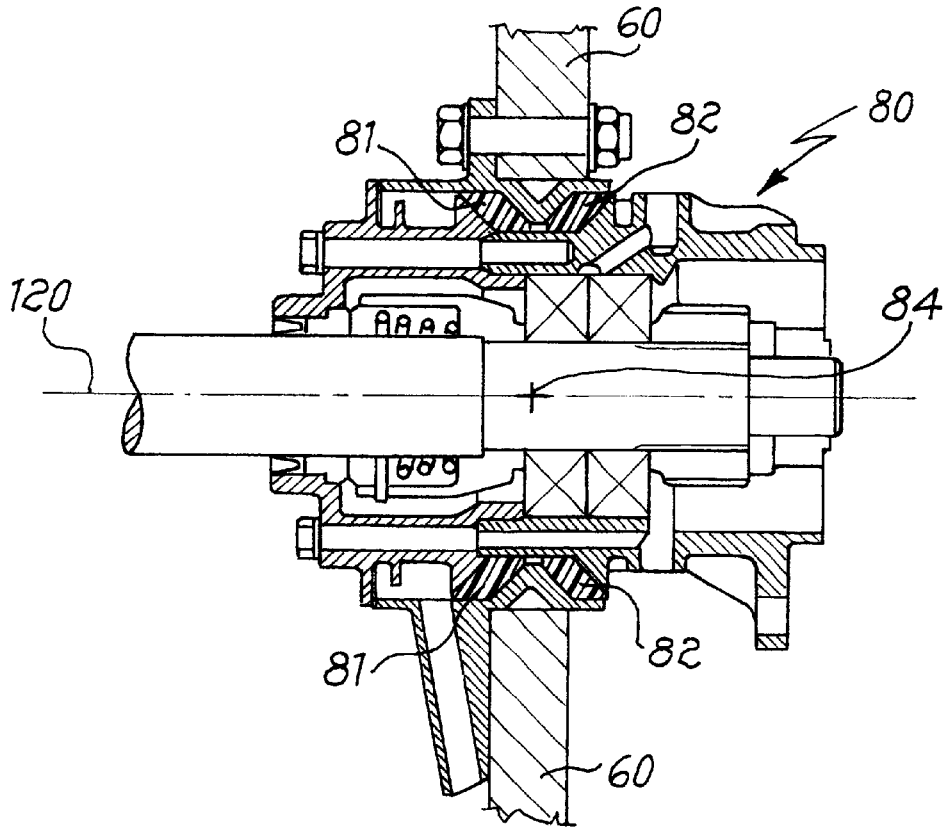
FIG. 5 is an enlarged longitudinal section view of a portion of the propulsion system illustrated in FIG. 4.

In this case, the reversing gearbox 40 is supported, at the crossing wall of the hull, by means of a device 80 similar to that described in the above-cited Italian Patent application no. MI96A-001151. The device 80, represented in more detail in the enlarged view of FIG. 5, includes in particular two elastic rings 81 and 82, for example of the "O-ring" type, that ensure the necessary seal within small variations in inclination of the rotation axis 120 of the propeller 20 around a pivoting axis 84 (perpendicular to FIGS. 4 and 5).

The support member 70 for the propeller shaft 6 may, in turn, include a device that allows the adjustment of the inclination of the propeller shaft, like that described for instance in the European Patent application no. EP-A-450507.

In particular, the support member 70 includes a foot portion 72 connected in adjustable way to a portion 73 that has a plate for attachment to the hull. The adjustment set is maintained by tightening the bolts 74.

According to the present invention, the portion 73 fixed to the hull 60 includes, in turn, a portion 71 that penetrates inside the hull and a bracket portion 75, connected to the portion 71 or integral with it, on which are fixed the attachments 35 of the motor unit 30. Between the bracket 75 and the attachments 35 are interposed the adjustment means 77 that allow the variation in the distance between the motor attachments 35 and the bracket 75. The means 77 may be of adjustable screw type, or could include simple spacing elements of various sizes to be interposed between the bracket 75 and the attachments 35 of the motor unit 30.

The adjustment of the inclination of the axis 120 of the propeller 20 is thus extremely simple. For this purpose, it is sufficient to act on the adjustment means 77, obviously after having loosened the bolts 74, to obtain rotation of the motor unit 30, of the reversing gearbox 40 and the propeller shaft 6 around the pivoting axis 84 without having to worry about the alignment problems. After adjustment, the desired inclination is maintained simply by tightening bolts 74 again.

Figure 6:
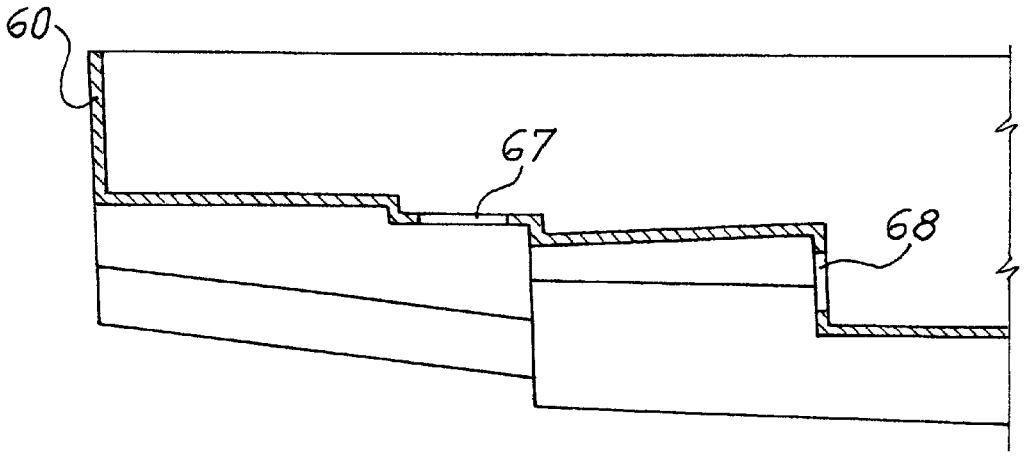
FIG. 6 is a longitudinal section view of the stern portion of a motor boat designed to receive a propulsion system according to the present invention.

FIG. 6 shows a hull 60 designed to house a propulsion system according to the present invention. The hull 60, made for instance by an injection moulding process, could already have, during the injection moulding stage, a hole 67 for the passage of the portion 51 (or 71) of the support member, as well as a hole 68 for the support of the reversing gearbox 40 and the exit of the propeller shaft 6, without having to worry about alignment problems during the installation of the propulsion system. The alignment is in fact already guaranteed during the planning of the propulsion system, according to the present invention.

Figure 7:
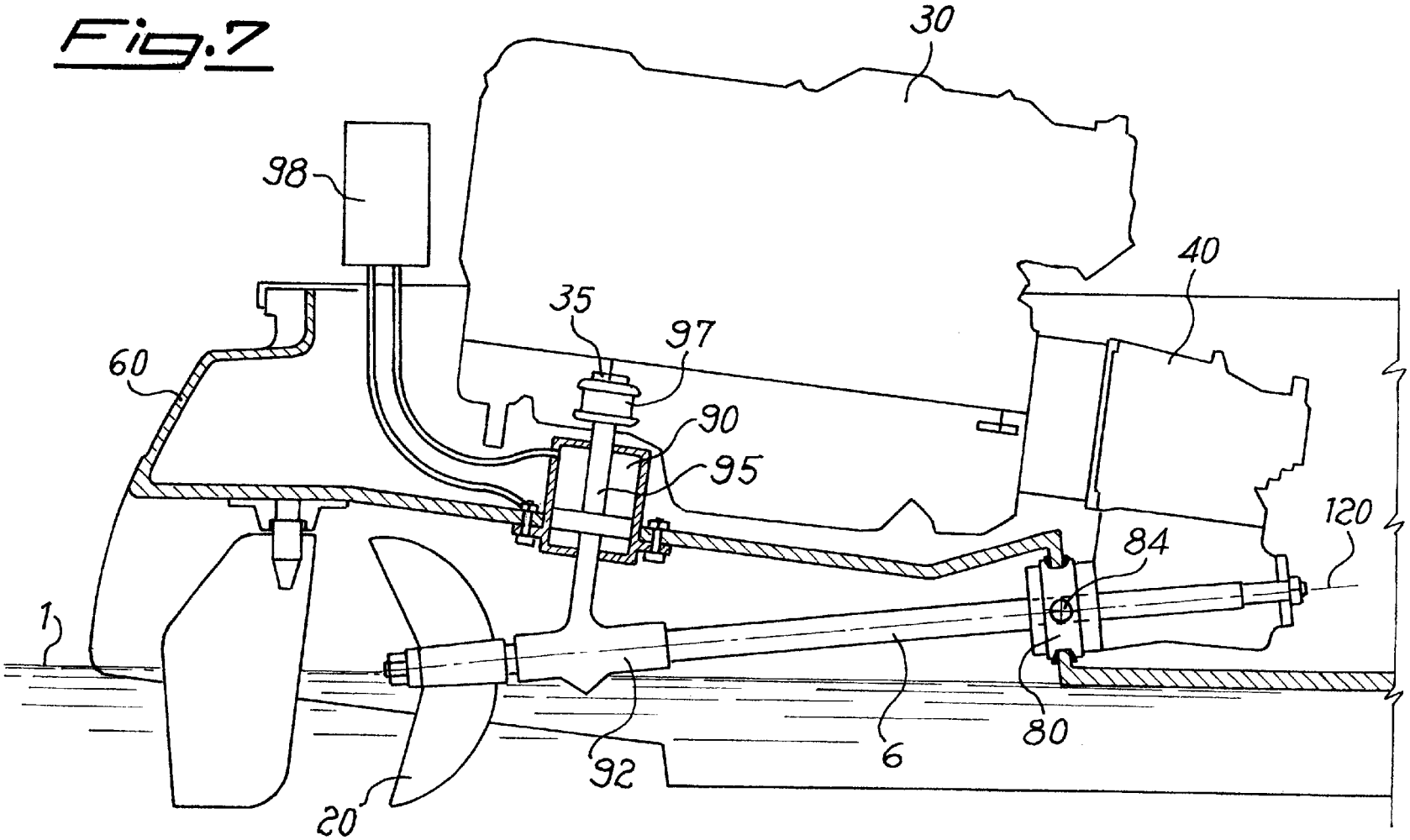
FIG. 7 is a longitudinal section view of the stern portion of a motor boat equipped with a propulsion system according to an additional possible embodiment of the present invention.

An additional possible embodiment of the "V-drive" type propulsion system according to the present invention is illustrated in FIG. 7.

In this case, the mechanical connection means between the motor unit 30 and support member 92 of the propeller shaft 6 include one or more hydraulic actuators 90, for instance of double effect type, controlled by a pump 98. The stem 95 of the hydraulic actuator illustrated in FIG. 7 is connected, at one of its ends, to the support member 92 of the propeller shaft 6 while, at the opposite end, the stem 95 of the hydraulic actuator 90 is connected to support devices 97, fixed or adjustable, on which rests an attachment 35 of the motor unit 30.

Similarly to the embodiment illustrated in FIG. 4, the reversing gearbox 40 is supported, at the crossing wall of bottom 60, by means of a device 80 (the same represented in more detail in FIG. 5) that maintains the seal also in the event of small variations in inclination of the propeller shaft 6.

The propulsion system is thus made "trimmable", i.e. adjustable, also during the running due to the hydraulic actuators 90 that allow the entire propulsion system to rotate, arranged according to a single "closed ring" integral structure, around the axis 84.

What is claimed is:

1. A V-drive propulsion system for motor boats, comprising:

at least one motor unit having a driving shaft, at least one reversing gearbox connected to the driving shaft of said motor unit for reversing the direction of the driving shaft from fore to aft, at least one propeller shaft to transmit the movement from said reversing gearbox back beneath the motor unit to a propeller of the system, and at least one support member for said propeller shaft, the support member being under and aligned with the engine unit, being spaced from the reversing gear box, and being fixed to the bottom of the hull near said propeller, the system including means to mechanically connect together said motor unit and said support member for the propeller shaft, wherein the motor unit, reversing gear box, propeller shaft and support unit form a closed mechanical loop, the support member including an adjuster extending between the hull and propeller shaft for adjusting the inclination of the propeller shaft with respect to the hull.

2. A propulsion system according to claim 1, wherein said reversing gearbox is integrally assembled with said motor unit.

3. A propulsion system according to claim 1, wherein said means for mechanical connection includes at least one portion of said support member protruding inside said hull.

4. A propulsion system according to claim 1, wherein said means of mechanical connection include one or more devices to support said motor unit.

5. A propulsion system according to claim 1, wherein said adjuster includes one or more hydraulic actuators.

6. A V-drive propulsion system for motor boats mounting in and on a hull adjacent the bottom thereof, comprising:

at least one motor unit, a reversing gearbox connected to a driving shaft of the motor unit, a propeller shaft extending back beneath the motor unit for transmitting rotation from the reversing gearbox to the propeller and a support member for the propeller shaft, the support member being under and aligned with the engine unit and being spaced from the reversing gearbox, and the support member being adapted to be fixed with respect to the bottom of the hull near the propeller, the motor unit and support member for the propeller shaft being mechanically coupled to one another by a direct mechanical connection to form a closed mechanical loop, which closed mechanical loop includes an adjuster for adjusting the inclination of the propeller shaft with respect to the engine unit and thus bottom of the hull when installed in a boat.

7. A propulsion system according to claim 6, wherein the reversing gearbox is integrally assembled with the motor unit.

8. A propulsion system according to claim 6, wherein the system is a V-drive system.

9. A propulsion system according to claim 6, where the direct mechanical connection includes at least one portion of the support member protruding into the hull.

10. A propulsion system according to claim 6, wherein the direct mechanical connection includes at least one device that supports the motor unit.

11. A propulsion system according to claim 6, wherein the direct mechanical connection includes at least one hydraulic actuator.

* * * * *

UNITED STATES PATENT AND TRADEMARK OFFICE

CERTIFICATE OF CORRECTION

PATENT NO. : 6,540,572 B2
DATED : April 1, 2003
INVENTOR(S) : Buzzi

It is certified that error appears in the above-identified patent and that said Letters Patent is hereby corrected as shown below:

Title page,
Item [30], Foreign Application Priority Data, change "MI00A1899" to -- M12000A001899 --.

Column 6,
Line 25, change "where" to -- wherein --.

Signed and Sealed this

Twenty-fourth Day of August, 2004

JON W. DUDAS
*Director of the United States Patent and Trademark Office*